US011633004B2

(12) United States Patent
Morsell

(10) Patent No.: US 11,633,004 B2
(45) Date of Patent: Apr. 25, 2023

(54) LEG PROTECTION DEVICE

(71) Applicant: Warfield T Morsell, Phoenix, AZ (US)

(72) Inventor: Warfield T Morsell, Phoenix, AZ (US)

( * ) Notice: Subject to any disclaimer, the term of this patent is extended or adjusted under 35 U.S.C. 154(b) by 212 days.

(21) Appl. No.: 17/098,499

(22) Filed: Nov. 16, 2020

(65) Prior Publication Data

US 2022/0151334 A1 May 19, 2022

(51) Int. Cl.
*A43B 7/20* (2006.01)

(52) U.S. Cl.
CPC ..... *A43B 7/20* (2013.01)

(58) Field of Classification Search
CPC ..... A41D 2600/102; A41D 2600/104; A41D 1/04; A41D 1/02; A43B 7/20; A43C 11/1493
See application file for complete search history.

(56) References Cited

U.S. PATENT DOCUMENTS 5,704,140 A * 1/1998 Fields ..... A43B 7/1495 36/132
7,458,950 B1 * 12/2008 Ivany ..... A43B 7/14 602/5
8,789,297 B1 * 7/2014 Doyle ..... A43B 13/122 36/130
9,629,418 B2 * 4/2017 Rushbrook ..... A43B 9/12
10,098,776 B2 * 10/2018 Zaccaria ..... A43B 7/20
10,596,023 B2 * 3/2020 Ostergard ..... A43B 7/20
11,109,636 B2 * 9/2021 Arin ..... A43B 1/0081
11,337,493 B2 * 5/2022 Hooper ..... A43B 13/14
2002/0066208 A1 * 6/2002 Hall ..... A43B 3/0078 36/100
2005/0188562 A1 * 9/2005 Clarke ..... A43B 3/0042 36/3 R
2005/0252041 A1 * 11/2005 Ramsey ..... A43B 3/0078 36/89
2006/0075661 A1 * 4/2006 Ramsey ..... A43B 23/24 36/89
2006/0201032 A1 * 9/2006 Ramsey ..... A43B 3/0078 36/89
2008/0223370 A1 * 9/2008 Kim ..... A41D 13/11 128/206.17
2009/0100578 A1 * 4/2009 Coates ..... A63B 71/1225 2/243.1
2009/0249646 A1 * 10/2009 Sylvestre ..... A43C 11/1493 36/114
2010/0088928 A1 * 4/2010 Sarantakos ..... A43C 11/1493 36/103
2010/0180469 A1 * 7/2010 Baucom ..... A43B 3/0031 36/55
2010/0313445 A1 * 12/2010 Hochdoerffer ..... A43C 11/08 36/50.1

(Continued)

*Primary Examiner* — Bao-Thieu L Nguyen
(74) *Attorney, Agent, or Firm* — Bruce A. Lev

(57) ABSTRACT

A leg protection device to be used in conjunction with footwear and adapted to removably wrap around a user's leg near or on their ankle to protect the user from rubbing and irritations caused by the footwear when worn and in use. A flexible panel is provided incorporating a plurality of apertures adapted to allow a chosen amount of air flow to the covered portion of the leg when needed. The flexible panel further includes edge portions around a perimeter thereof and surrounding each of the apertures and made from a material adapted to increase comfort to the user while in use.

18 Claims, 3 Drawing Sheets

(56) References Cited

U.S. PATENT DOCUMENTS

| | | | | |
|---|---|---|---|---|
| 2012/0204359 | A1* | 8/2012 | Adami | A43B 3/24 12/142 R |
| 2014/0137432 | A1* | 5/2014 | Eldem | A43B 1/0081 24/713 |
| 2014/0259286 | A1* | 9/2014 | Boyle | A41D 20/00 2/181 |
| 2016/0113802 | A1* | 4/2016 | Zaccaria | A43B 7/32 29/428 |
| 2017/0079827 | A1* | 3/2017 | Ostergard | A61F 5/0111 |
| 2017/0224055 | A1* | 8/2017 | Hooper | A43B 13/14 |
| 2017/0238645 | A1* | 8/2017 | Arin | A43B 3/0078 |
| 2017/0325987 | A9* | 11/2017 | Zaccaria | A61F 5/0127 |
| 2018/0116343 | A1* | 5/2018 | Hei | A43C 11/00 |
| 2018/0242680 | A1* | 8/2018 | Arin | A43B 13/04 |
| 2019/0133256 | A1* | 5/2019 | Van Horne | A43B 5/1691 |
| 2020/0037703 | A1* | 2/2020 | Twist | A43C 11/1493 |
| 2020/0093628 | A1* | 3/2020 | Sigurdsson | A43B 7/20 |
| 2020/0163790 | A1* | 5/2020 | Ostergard | A61F 5/0111 |
| 2020/0245719 | A1* | 8/2020 | Gooch | A43B 13/40 |
| 2020/0359745 | A1* | 11/2020 | Tresser | A43B 7/24 |
| 2021/0153605 | A1* | 5/2021 | Hopkins | A43C 11/1493 |
| 2021/0259356 | A1* | 8/2021 | Maselino | A43C 1/003 |

* cited by examiner

LEG PROTECTION DEVICE

CROSS-REFERENCE TO RELATED APPLICATION

There are no related applications incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates generally to leg protection devices used in conjunction with footwear and adapted to protect a user from rubbing and irritations caused by footwear when worn and in use.

2. Description of the Related Art

Prior leg protection devices are merely placed upon or wrap around a user's leg near or on their ankle to protect the user from rubbing and irritations caused by footwear when worn and in use. However, they do not provide a means to allow air flow to the covered portion of the leg when needed, nor provide comforting means when applied thereby causing long term use irritations.

Accordingly, the present invention overcomes these disadvantages associated with the prior art.

BRIEF SUMMARY OF THE INVENTION

In view of the foregoing disadvantages inherent in the prior art, the present invention provides a leg protection device to be used in conjunction with footwear and adapted to removably wrap around a user's leg near or on their ankle to protect the user from rubbing and irritations caused by the footwear when worn and in use. A flexible panel is provided incorporating a plurality of apertures adapted to allow a chosen amount of air flow to the covered portion of the leg when needed. The flexible panel further includes edge portions around a perimeter thereof and surrounding each of the apertures and made from a material adapted to increase comfort to the user while in use.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

The figures which accompany the written portion of this specification illustrate embodiments according to the teachings of the present invention.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

Figure 1:
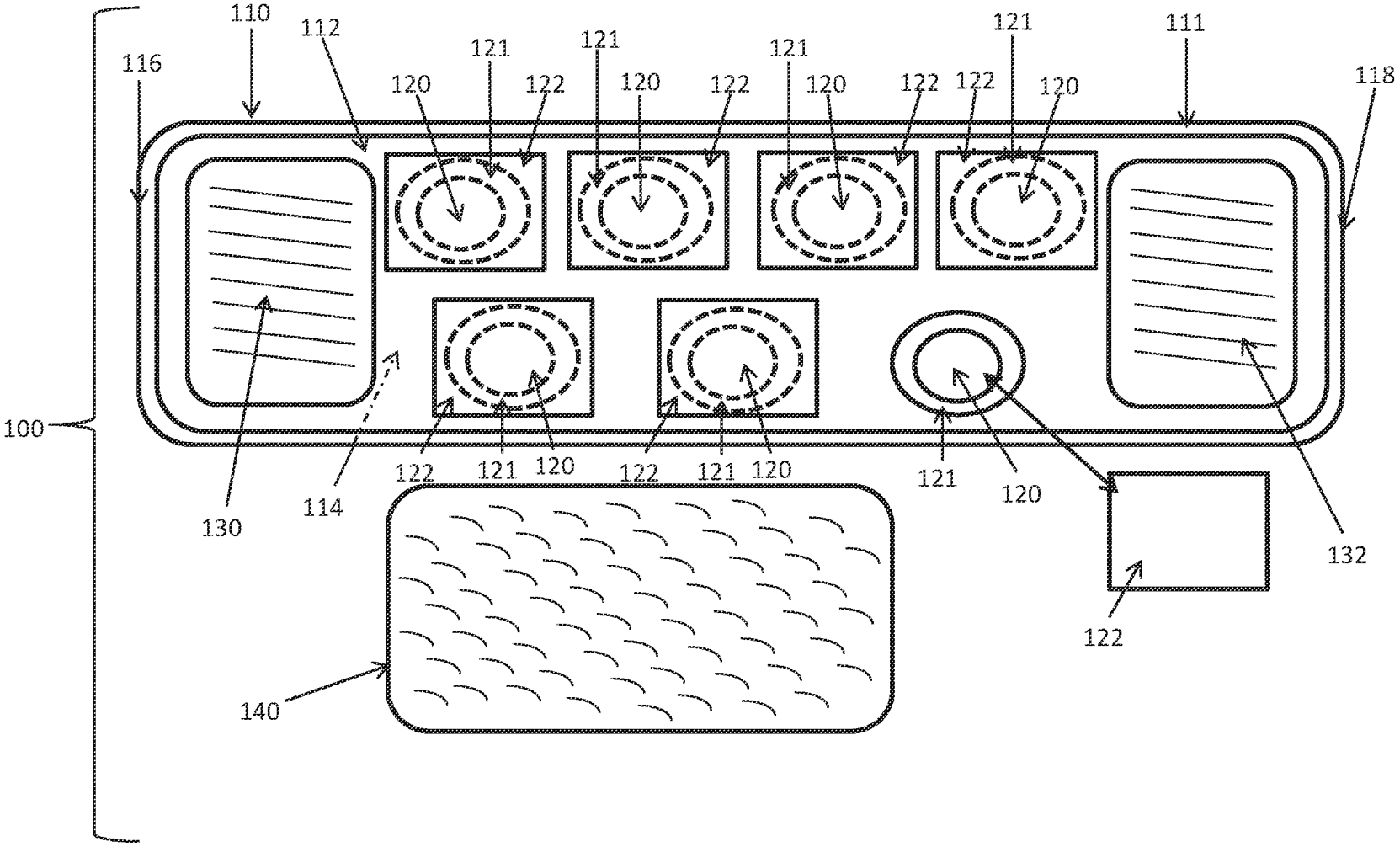
FIG. 1 shows a front view of the leg protection device according to the preferred embodiment of the present invention.
Figure 2:
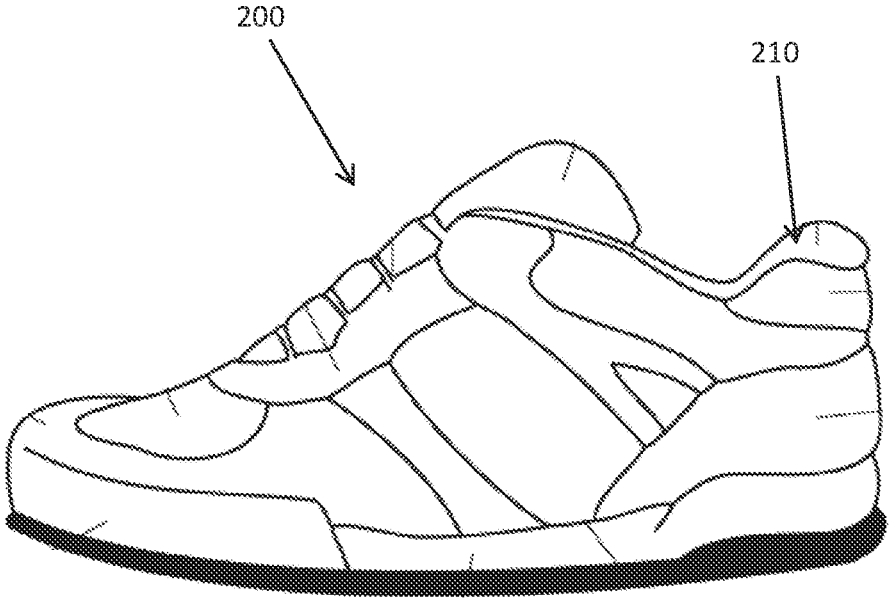
FIG. 2 shows a side view of footwear to which the leg protection device may be used according to the preferred embodiment of the present invention of FIG. 1.
Figure 3:
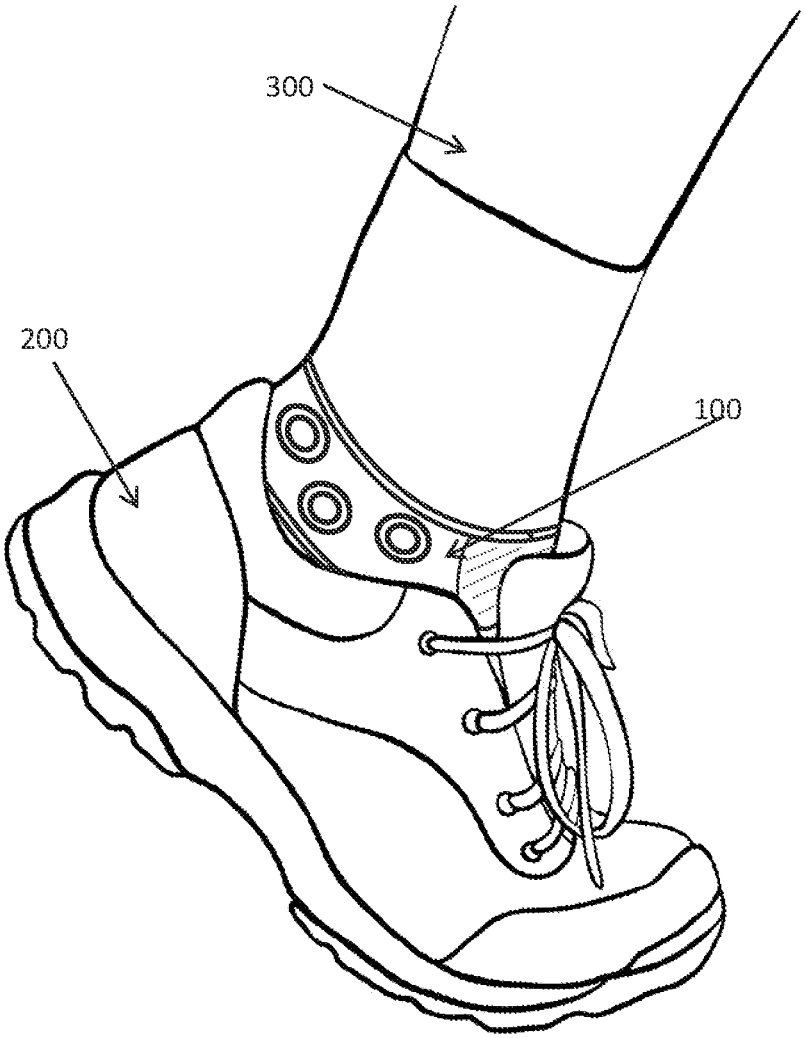
FIG. 3 shows a perspective view of the leg protection device in use with footwear according to the preferred embodiment of the present invention of FIG. 1.

Turning now descriptively to FIGS. 1-3, the present invention discloses a leg protection device 100 to be used in conjunction with footwear 200. The footwear 200 includes upper and inner portions, including a collar portion 210, which rubs against a user's leg 300 when in use, thus causing irritations and eventual injuries to the user's leg. The leg protection device 100 comprises an elongated flexible panel 110, including a front surface 112, a back surface 114, a proximal end portion 116, a distal end portion 118, and a plurality of apertures 120 spaced from one another and extend through said front and back surfaces, and are adapted to allow air to pass therethrough, a plurality of aperture panels 122 removably attached to the flexible panel at positions that respectively cover each of the plurality of apertures and are adapted such that when attached to the flexible panel air cannot pass through the plurality of apertures, and when removed from the flexible panel air can pass through respective apertures. The plurality of aperture panels 122 are adapted to be individually removed from the flexible panel such that air can flow through chosen ones of the plurality of apertures and thereby control the airflow through the elongated flexible panel. The leg protection device 100 further comprises a first connector panel 130 connected to the proximal end portion and on the front surface of the elongated flexible panel, a second connector panel 132 connected to the distal end portion and on the front surface of the elongated flexible panel, a third connector panel 140 removably connectable to the first connector panel and the second connector panel, wherein the elongated flexible panel 110 is adapted to wrap around a person's leg in proximity to their ankle and adapted to protect the leg from friction and injuries caused by the use of the footwear upon the person's foot. The second connector panel 132 is adapted to be removably connected to the first connector panel 130 after the elongated flexible panel is wrapped around the person's leg in proximity to their ankle, and is thereby adapted to be securely and removably connected to the person's leg before the footwear is placed upon the person's foot.

The elongated flexible panel 110 may formed having a rectangular shape, though other shapes, including undulating edges, may be chosen and used.

As shown in FIG. 1, the first connector panel 130 may include hooks from a hook and loop fastening material, the second connector panel 132 may include hooks from a hook and loop fastening material, and the third connector panel 140 may include loops from a hook and loop fastening material, such that the third connector panel is adapted to be removably connected to the first and second connector panels after the improved protective shield is wrapped around the person's leg, thereby removably securing the improved protective shield to the person's leg before the footwear is placed upon the person's foot. Other types of removable connector members can be substituted, however, hook and loop fasteners may be the quickest and easiest to use in the instant environment.

As shown in FIG. 1, the elongated flexible panel 110 may further include an outer perimeter 111 and inner edge portions 121 respectively surrounding each of the plurality of apertures and may be formed from a semi-rigid material adapted to retain the shape of the elongated flexible panel and the plurality of apertures. The semi-rigid material of said outer perimeter and inner edge portions may be formed from polypropylene plastic or from open-celled foam. The elongated flexible panel 110 may formed from an elastic material including polyester, nylon, spandex, lycra, or elastane, and wherein the plurality of aperture panels 122 may be removably attached to the flexible panel via an adhesive, though other glues and materials can be used to provide the same function.

As shown in FIG. 1, the plurality of apertures are spaced from one another in an alternating pattern, wherein every other aperture is located in proximity to an upper edge portion of the elongated flexible panel, and each aperture therebetween is located in proximity to a lower edge portion of the elongated flexible panel.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. A leg protection device to be used in conjunction with footwear, comprising:

an elongated flexible panel, including
- a front surface;
- a back surface;
- a proximal end portion;
- a distal end portion; and
- a plurality of apertures;
  - wherein said plurality of apertures are spaced from one another and extend through said front and back surfaces, and are adapted to allow air to pass therethrough;

a plurality of aperture panels;
- wherein said plurality of aperture panels are removably attached to said flexible panel at positions that respectively cover each of said plurality of apertures, and are adapted such that when attached to said flexible panel air cannot pass through said plurality of apertures, and when removed from said flexible panel air can pass through respective apertures; and
- wherein said plurality of aperture panels are adapted to be individually removed from said flexible panel, such that air can flow through chosen ones of said plurality of apertures, and thereby control the airflow through said elongated flexible panel;

a first connector panel;
- wherein said first connector panel is connected to said proximal end portion and on said front surface of said elongated flexible panel;

a second connector panel;
- wherein said second connector panel is connected to said distal end portion and on said front surface of said elongated flexible panel;

a third connector panel;
- wherein said third connector panel is removably connectable to said first connector panel and said second connector panel;

wherein said elongated flexible panel is adapted to wrap around a person's leg in proximity to their ankle before footwear is placed upon said person's foot, and is adapted to protect said leg from friction and injuries caused by the use of said footwear upon said person's foot wherein said first connector panel includes hooks from a hook and loop fastening material; wherein said second connector panel includes hooks from a hook and loop fastening material; and wherein said third connector panel includes loops from a hook and loop fastening material, such that said third connector panel is adapted to be removably connected to said first and second connector panels after said elongated flexible panel is wrapped around said person's leg, thereby removably securing said improved protective shield to said person's leg before said footwear is placed upon said person's foot.

2. The leg protection device of claim 1, wherein said elongated flexible panel is formed having a rectangular shape.

3. The leg protection device of claim 1, wherein said elongated flexible panel further includes inner edge portions respectively surrounding each of said plurality of apertures and around an outer perimeter thereof formed from a semi-rigid material adapted to retain the shape of said plurality of apertures.

4. The leg protection device of claim 3, wherein said semi-rigid material of said inner edge portions is plastic.

5. The leg protection device of claim 3, wherein said plastic is polypropylene.

6. The leg protection device of claim 3, wherein said semi-rigid material of said inner edge portions is open-celled foam.

7. The leg protection device of claim 1, wherein said elongated flexible panel is formed from an elastic material; and wherein said plurality of aperture panels are removably attached to said flexible panel via an adhesive.

8. The leg protection device of claim 1, wherein said elastic material is chosen from a list of materials consisting of polyester, nylon, spandex, and elastane.

9. The leg protection device of claim 1, wherein said plurality of apertures are spaced from one another in an alternating pattern, wherein every other aperture is located in proximity to an upper edge portion of said elongated flexible panel, and each aperture therebetween is located in proximity to a lower edge portion of said elongated flexible panel.

10. A combination of footwear and at least one leg protection device to be used in conjunction with said footwear, said combination comprising:

footwear;

wherein said footwear is adapted to be removably secured to a person's feet; and at least one leg protection device, comprising:

an elongated flexible panel, including a front surface;

a back surface;

a proximal end portion;

a distal end portion; and a plurality of apertures;

wherein said plurality of apertures are spaced from one another and extend through said front and back surfaces, and are adapted to allow air to pass therethrough;

a plurality of aperture panels;

wherein said plurality of aperture panels are removably attached to said flexible panel at positions that respectively cover each of said plurality of apertures, and are adapted such that when attached to said flexible panel air cannot pass through said plurality of aperture, and when removed from said flexible panel air can pass through respective apertures; and wherein said plurality of aperture panels are adapted to be individually removed from said flexible panel, such that air can flow through chosen ones of said plurality of apertures, and thereby control the airflow through said elongated flexible panels;

a first connector panel;

wherein said first connector panel is connected to said proximal end portion and on said front surface of said elongated flexible panel;

a second connector panel;

wherein said second connector panel is connected to said distal end portion and on said front surface of said elongated flexible panel;

a third connector panel;

wherein said third connector panel is removably connectable to said first connector panel and said second connector panel;

wherein said elongated flexible panel is adapted to wrap around a person's leg in proximity to their ankle before said footwear is placed upon said person's foot, and is adapted to protect said leg from friction and injuries caused by the use of said footwear upon said person's foot wherein said first connector panel includes hooks from a hook and loop fastening material; wherein said second connector panel includes hooks from a hook and loop fastening material; and wherein said third connector panel includes loops from a hook and loop fastening material, such that said third connector panel is adapted to be removably connected to said first and second connector panels after said elongated flexible panel is wrapped around said person's leg, thereby removably securing said improved protective shield to said person's leg before said footwear is placed upon said person's foot.

11. The combination of claim 10, wherein said footwear is chosen from a list of footwear consisting of shoes, sneakers, high-top sneakers, roller skates, and ice skates.

12. The combination of claim 10, wherein said elongated flexible panel further includes inner edge portions respectively surrounding each of said plurality of apertures and formed from a semi-rigid material adapted to retain the shape of said apertures.

13. The combination of claim 12, wherein said semi-rigid material of said inner edge portions is plastic.

14. The combination of claim 12, wherein said plastic is polypropylene.

15. The combination of claim 12, wherein said semi-rigid material of said inner edge portions is open-celled foam.

16. The combination of claim 10, wherein said elongated flexible panel is formed from an elastic material.

17. The combination of claim 10, wherein said elastic material is chosen from a list of materials consisting of polyester, nylon, spandex, and elastane.

18. The combination of claim 10, wherein said plurality of apertures are spaced from one another in an alternating pattern, wherein every other aperture is located in proximity to an upper edge portion of said elongated flexible panel, and each aperture therebetween is located in proximity to a lower edge portion of said elongated flexible panel.

* * * * *